US006308672B1

(12) United States Patent
Lichti et al.

(10) Patent No.: US 6,308,672 B1
(45) Date of Patent: Oct. 30, 2001

(54) FRONT-MOUNTING CAM PHASER MODULE

(75) Inventors: Thomas Howard Lichti, Fairport; Michael James Fox, Stafford, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/632,990

(22) Filed: Aug. 4, 2000

Related U.S. Application Data

(60) Provisional application No. 60/147,329, filed on Aug. 5, 1999.

(51) Int. Cl.[7] ..... F01L 1/344

(52) U.S. Cl. ..... 123/90.17; 123/90.33; 123/90.38

(58) Field of Search ..... 123/90.15, 90.17, 123/90.31, 90.33, 90.38

(56) References Cited

U.S. PATENT DOCUMENTS 5,301,639 * 4/1994 Satou ..... 123/90.17
5,474,038 * 12/1995 Golovatai-Schmidt et al. . 123/90.17
5,540,197 * 7/1996 Golovatai-Schmidt et al. . 123/90.17
5,797,363 * 8/1998 Nakamura ..... 123/90.17
5,988,126 * 11/1999 Strauss et al. ..... 123/90.17

* cited by examiner

*Primary Examiner*—Wellun Lo
(74) *Attorney, Agent, or Firm*—John A. VanOphem

(57) ABSTRACT

A modular vane cam phaser assembly for controllably and continuously varying the rotational phase between a camshaft and the crankshaft of a reciprocating internal combustion engine. The module includes a housing mountable to the front of an engine head, the housing supporting on an outer surface thereof a programmably-controllable spool valve for directing pressurized oil to an oil commutator extending into both the housing and a vane phaser wherein a rotor is bolted to the camshaft and a stator is bolted to a timing sprocket. The oil is distributed by the spool valve to opposite sides of the rotor vanes in response to signals generated by an induction cam rotation sensor and by other engine components and processed by a powertrain control module to advance or retard the opening of intake and/or exhaust valves in the engine. The housing is provided with internal passages for supplying oil from an engine port to the spool valve. Preferably, the oil is filtered by a thimble screen as it enters the housing.

11 Claims, 5 Drawing Sheets

FRONT-MOUNTING CAM PHASER MODULE

CROSS-REFERENCE TO RELATED APPLICATIONS

This application claims the benefit of U.S. Provisional Patent Application Ser. No. 60/147,329, filed Aug. 5, 1999.

TECHNICAL FIELD

The present invention relates to cam phasers for reciprocating internal combustion engines for altering the phase relationship between valve motion and piston motion, more particularly to cam phasers which are mountable on the front or forward ends of camshafts, and most particularly to a front-mounting cam phaser module which is readily adaptable to existing engine head and cam cover dimensions, requires no modification of the camshaft, and presents the necessary control valves, control circuitry, and oil supply outside the cam cover.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds. As is known, under some operating conditions it is desirable to delay or advance the closing and opening of either the intake valves or the exhaust valves or both, relative to the valving in a similar engine having a fixed relationship between the crankshaft and the camshaft.

Typically, cam phasers employ a first element driven in fixed relationship to the crankshaft and a second element adjacent to the first element and mounted to the end of the camshaft in either the engine head or block. In modem automotive engines, the camshafts are typically disposed in the engine head for direct actuation of the valve tappets. Cam phasers are commonly disposed at the crankshaft and camshaft ends opposite the engine flywheel, herein referred to as the "front" end of the engine.

The first and second phaser elements are connected typically in one of two ways to cause the crankshaft to rotate the camshaft. In the older known art, a helically-splined coupling between the elements is driven axially by a hydraulic ram such that axial motion of the ram is translated into change of rotational phase between the two elements.

In the newer known art, the first element is typically a cylindrical stator mounted coaxially to a crankshaft-driven gear or pulley and having a plurality of radially-disposed chambers and an axial bore, and the second element is a vaned rotor mounted to the end of the camshaft through the stator bore and having a vane disposed in each of the stator chambers such that limited relative rotational motion is possible between the stator and the rotor. The chambers are sealed typically by front and rear face seals of the stator. The apparatus is provided with suitable porting so that hydraulic fluid, for example, engine oil under engine oil pump pressure, can be brought to bear controllably on opposite sides of the vanes in the chambers. Control circuitry and valving, commonly a multiport spool valve, permits the programmable control of the volume of oil on opposite sides of each vane to cause a change in rotational phase between the stator and the rotor, in either the rotationally forward or backwards direction.

A serious problem is known in adapting existing engine designs to cam phasers. A cam phaser can occupy considerable volume in the region immediately beyond the end of the camshaft and can also substantially complicate positioning of the first cam bearing and routing of oil passages in the engine head. Existing engine designs and manufacturing tooling typically provide little unoccupied space for such addition within the engine envelope, especially within the cam cover. Extending the length of the cam cover and head specifically to accommodate a phaser generally is prohibitively expensive and not feasible; thus, phasers typically are incorporated into engines only when an entirely new engine design is put forth, for example, the Unitech phaser in the BMW M50 engine, the Mercedes phaser in the 500SL 5-litre engine, and the INA phaser in the Ford Escort Zetec engine.

Further, known hydraulically-driven phasers typically utilize pressurized engine oil which can contain significant amounts of sludge and/or engine-manufacturing debris which can foul or damage moving parts of a phaser, especially the spool valve typically used to regulate flow to the chambers. Some phasers, for example, the INA phaser noted above, have the spool valve within the cam cover where it is not readily accessible for service or repair.

Further, known phasers are not fully modular and can require careful, tedious assembly of components in sequence onto the camshaft. In addition, some known phasers require substantial modification to the end of the camshaft, for example, hydraulic porting.

What is needed is a front-mounting cam phaser module a) containing stator, rotor, control valve and electrical connectors, and inline oil filter which can be assembled and tested off-line; b) requiring minimal redesign and no lengthening of the cam cover and head; c) requiring no or minimal modification of the camshaft; d) providing simple attachment as a module to the camshaft and head of an existing-design engine; and e) resulting in minimal increase in the overall length of the engine.

SUMMARY OF THE INVENTION

The present invention is directed to a modular vane cam phaser (VCP) assembly for controllably and continuously varying the rotational phase between the camshaft and the crankshaft of a reciprocating internal combustion engine. The module includes a housing mountable to the front of an engine head, the housing supporting a programmably-controllable spool valve for directing pressurized oil to an oil commutator extending into both the housing and a cam phaser having a vaned rotor attached to the camshaft and a chambered stator attached to a timing sprocket. Oil is distributed to opposite sides of the rotor vanes in the stator chambers in response to signals generated by a cam rotation sensor and other engine components and processed by a powertrain control module to advance or retard the opening of intake and/or exhaust valves in the engine. The housing is provided with internal passages for supplying oil from an engine port to the spool valve. Preferably, the oil is filtered by a thimble screen as it enters the housing.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1:
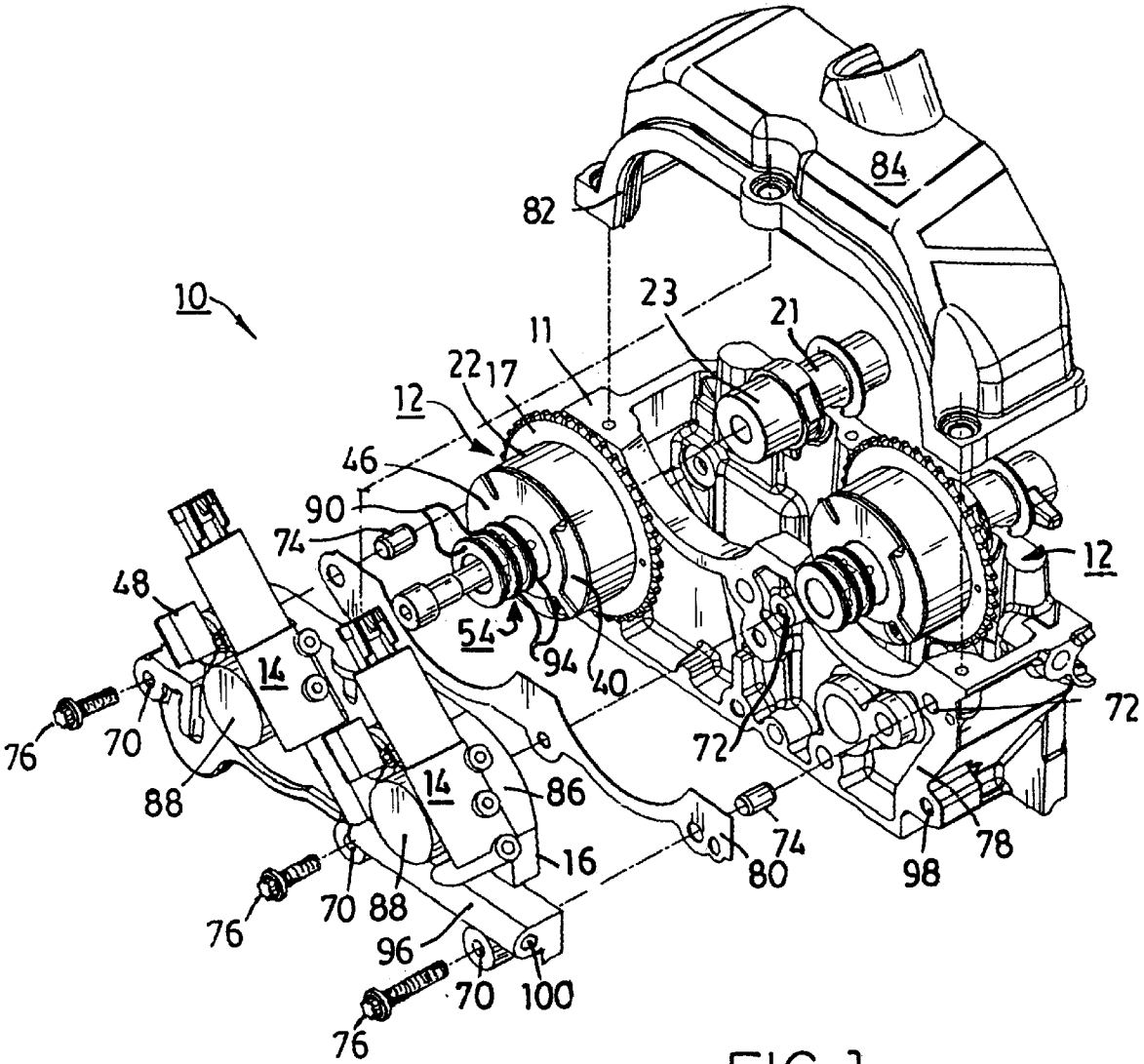
FIG. 1 is an exploded isometric view from above of a cam phaser module in accordance with the invention, showing a dual-phaser embodiment in relationship to an engine head and intake and exhaust camshafts therein.
Figure 2:
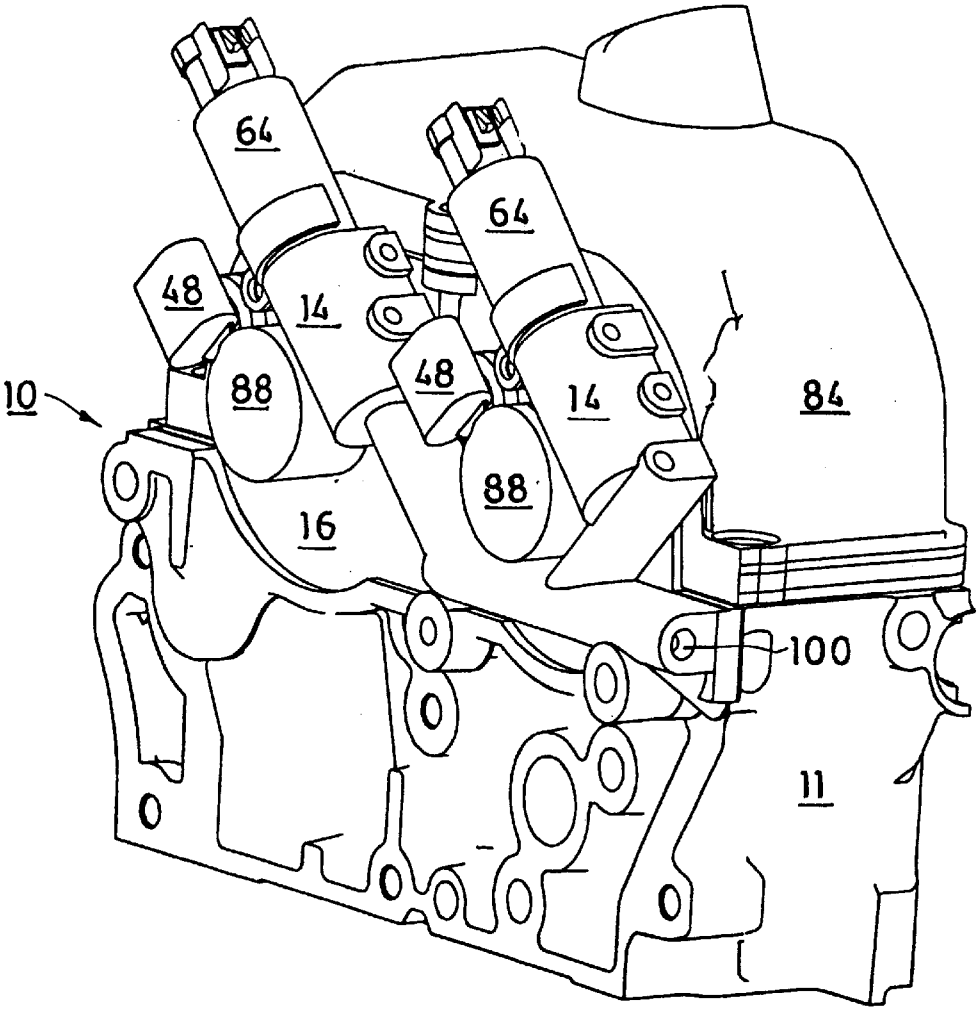
FIG. 2 is an isometric view from above showing as assembled the cam phaser module and engine head shown in FIG. 1.
Figure 3:
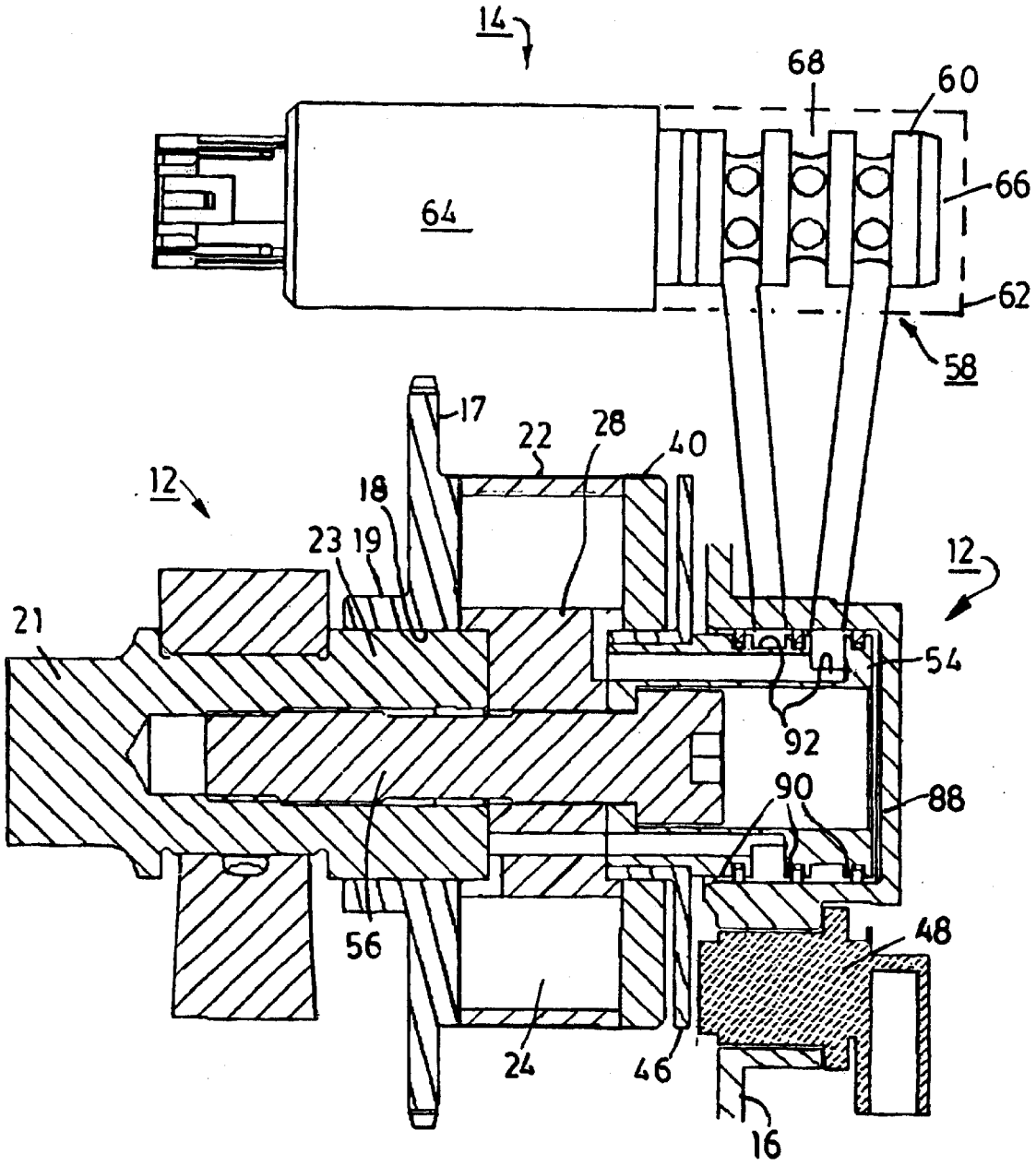
FIG. 3 is a longitudinal cross-sectional view of a cam phaser sub-assembly and a schematic view of a control valve sub-assembly, as shown in FIG. 1.
Figure 4:
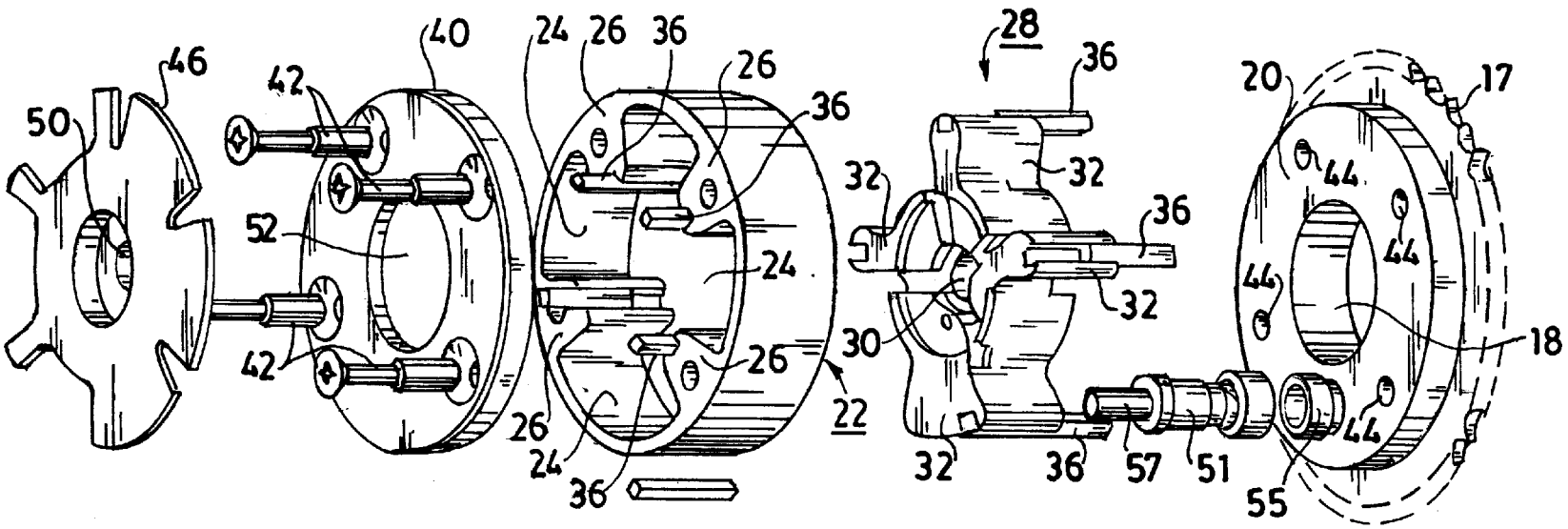
FIG. 4 is an exploded isometric view of the cam phaser shown in FIG. 1.
Figure 5:
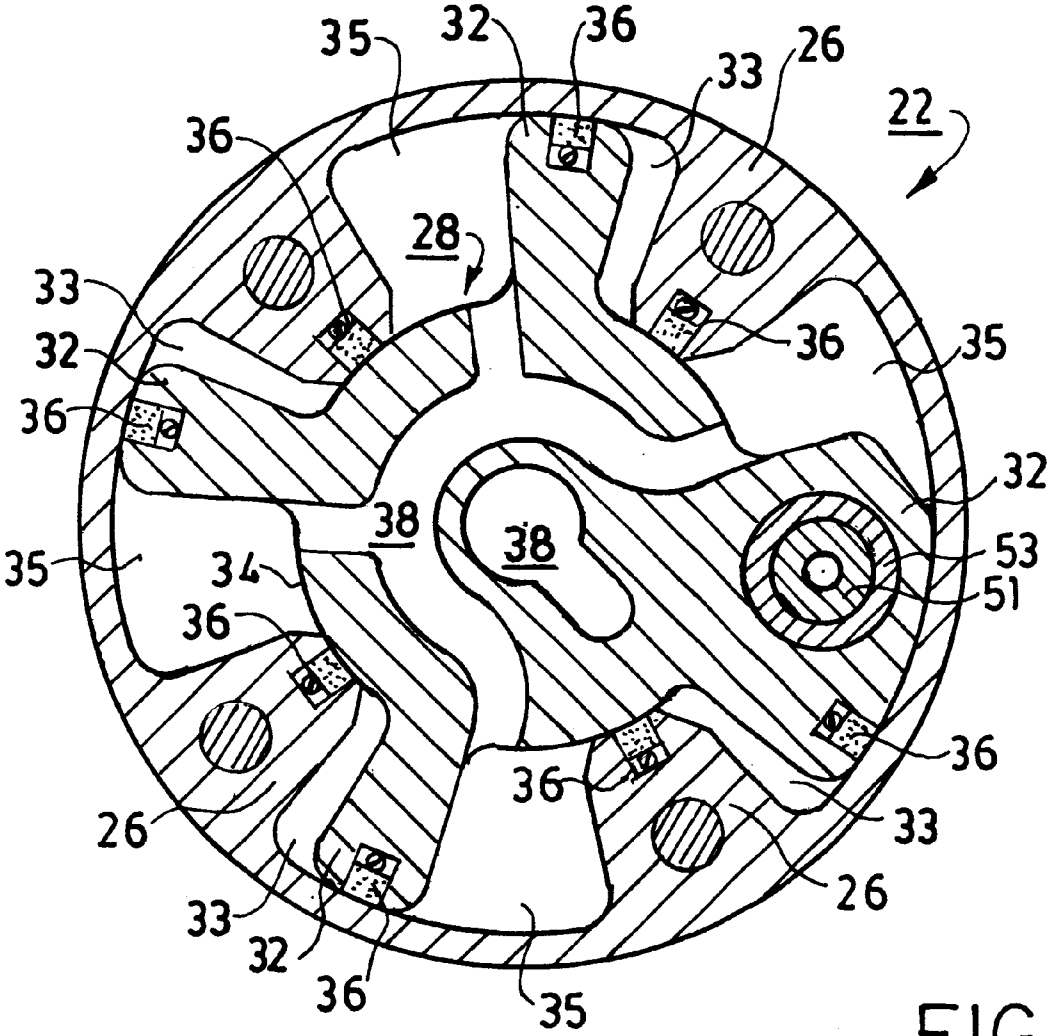
FIG. 5 is a cross-sectional view of the cam phaser shown in FIG. 1, showing the relationship of the stator and rotor.

Referring to FIGS. 1–5, a cam phaser module 10 for a dual overhead cam engine head 11 comprises two vane phaser sub-assemblies 12, two control valve sub-assemblies 14, and a supportive housing 16. The components are united during engine assembly to provide the final VCP assembly, as shown in FIG. 2. For clarity, the following presentation deals with only one phaser sub-assembly and one control valve sub-assembly for one of the cams, the assemblies for the other cam being substantially identical with those discussed.

Phaser sub-assembly 12 includes a sprocket 17 (or alternatively, for timing belt driven cams, a ribbed pulley) for receiving the engine timing chain (not shown) in conventional fashion. Sprocket 17 has a central bore 18 surrounded by a cylindrical flange 19, and a front face defining a sealing surface 20. Camshaft 21 is provided with bearing 23 extending through bore 18 permitting sprocket 17 to rotate independently of camshaft 21. A generally cylindrical stator 22 having a plurality of radial chambers 24 separated by a plurality of radial lands 26, preferably four of each, is sealingly and coaxially disposed against sprocket surface 20. If desired, a gasket (not shown) may be installed therebetween to ensure against leakage. A rotor 28 having a central bore 30 and the same plurality of vanes 32 is disposed coaxially within stator 22, each one of vanes 32 serving to subdivide a one of chambers 24 into first and second subchambers 33,35, respectively. Hub 34 of rotor 28 is matable with the tips of stator lands 26 to hydraulically separate the chambers from each other. Preferably, each stator land and each rotor vane is provided with a longitudinal seal 36 to improve the hydraulic separation between the chambers and subchambers, respectively. Rotor 28 is provided with passages 38 for delivering oil to opposite sides of each vane 32 in each chamber 24. A cover plate 40 is sealingly and concentrically disposed against the stator to seal the chambers and rotor from the front side. Binder screws or bolts 42 extend through the cover and stator into threaded bores 44 in sprocket 17. A gasket (not shown) may be installed between stator and cover plate to ensure against leakage. A target wheel 46 (preferably a ferromagnetic sectored wheel) for a camshaft rotation sensor 48 (preferably an induction-type sensor) is mounted over the cover plate, having a central well 50 extending through a central bore 52 in cover plate 40. A hollow cylindrical oil commutator 54 having porting for distributing oil to the rotor passages and subchambers is also disposed through central bore 52 into communication with the rotor. The phaser sub-assembly is secured to the end of camshaft 21 with a single central bolt 56, the rotor thus being fixedly mounted by the bolt to the camshaft, and the stator being mounted by the binder screws to the timing sprocket.

Preferably, phaser sub-assembly 12 is further provided with means for locking rotor 28 in fixed phase relationship to stator 22, for example, during engine shutdown. Such fixed and predetermined relationship can be important when the engine is restarted. Preferably, a locking pin 51 is slidingly disposed in a blind bore 53 in an oversize vane of rotor 28, bore 53 facing toward a socket 55 in sprocket 17. Pin 51 is biased toward socket 55 by a spring 57 behind pin 51 in bore 53. The pin is restrained in the bore by oil pressure while the engine is running, but as the engine runs down after shut-off, the spring overcomes the falling oil pressure and extends the pin into the socket on the sprocket, locking the stator and rotor in a predetermined phase relationship. Upon restart of the engine, the pin is retracted into the bore by oil pressure and the phaser is free again to vary the phase relationship.

Control valve sub-assembly 14 includes a 4-port spool valve having a spool 60 axially actuatable in valve body 62 by a programmable linear solenoid 64 to selectively open and close entry ports 66 and exit ports 68 in the valve body and through the spool for passage of engine oil under pressure, received from housing 16, through oil commutator 54 and thence into and out of subchambers 33,35. Varying the axial position of the spool in the valve body varies the amount of oil delivered to opposite sides of vanes 32, thereby varying inversely the combined volumes of subchambers 33,35, respectively and, hence, the rotational position of the vanes in the chambers and, hence, the phase relationship between the timing sprocket and the camshaft.

Housing 16, formed preferably as a metal casting, performs several functions. Housing 16 is provided with precision bores 70 corresponding to threaded bores 72 in head 11 for receiving hollow alignment dowels 74 and bolts 76, such that housing 16 is precisely positioned with respect to head 11. Housing 16 may be sealed against face 78 of head 11 by gasket 80. The curved lip 82 of camcover 84 is conformable with and seals against upper surface 86 of housing 16 to complete the shroud enclosure of the cam phasers within the engine assembly.

Housing 16 supports control valve sub-assembly 14 and is further provided with a blind well 88 coaxial with camshaft 21 for receiving the outer portion of oil commutator 54, which itself is further provided with a plurality of circumferential ridges 90 defining oil flow troughs 92 therebetween. Ridges 90 preferably are equipped with seals 94 for sealing against the walls of well 88 to prevent leakage between troughs 92. Troughs 92 are connected to valve ports 66,68 by appropriate passages in housing 16.

Housing 16 is further provided with an entry oil passage 96 having a port matable with an oil supply port 98 in head 11. Preferably, passage 96 includes a closable chamber 100 for receiving a thimble screen or filter (not visible in FIG. 1 or 2) for filtering engine oil as it enters cam phaser module 10.

In operation, spool valve 58 directs pressurized oil through commutator 54 into chambers 24 on opposite sides of vanes 32, thereby selectively establishing the desired phase relationship between timing sprocket 17 and camshaft 21. The amount of oil passed to opposite sides of each vane is dictated by the vehicle powertrain master controller (not shown) which analyzes the status of multiple engine operating parameters, including the phase relationship of the crank and cam via signals from cam sensor 48, and determines, moment by moment, the optimum crank/cam phase relationship. When the desired phase relationship is achieved, the valve spool is moved to a null position wherein the ports are occluded and oil in the chambers is captive. This provides a rotationally "hard" and non-resilient medium between cam and sprocket, which can be highly important in providing precise timing of valve opening and closing. Oil which is withdrawn from the chambers to permit rotation of the rotor with respect to the stator to achieve the desired phase relationship is returned via valve vent ports 102 to the engine crankcase.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. front-mounting camshaft phaser module for shifting rotational phase between an engine crankshaft and intake valve camshaft and between an engine crankshaft and an exhaust valve camshaft, comprising:

a) a housing connectable to said engine;

b) a first cam phaser sub-assembly including a timing sprocket, stator, rotor, a plurality of chambers formed between said stator and said rotor, cover plate, and oil commutator, said first phaser sub-assembly being disposed on an end of said intake valve camshaft and extending into a first well in said housing;

c) a second cam phaser sub-assembly including a timing sprocket, stator, rotor, a plurality of chambers formed between said stator and said rotor, cover plate, and oil commutator, said second phaser sub-assembly being disposed on an end of said exhaust valve camshaft and extending into a second well in said housing;

d) a first control valve sub-assembly disposed on an outer surface of said housing and having oil inlet and outlet ports in communication with said commutator in said first cam phaser sub-assembly for passing oil into and out of said chambers to vary the phase relationship between said crankshaft and said intake valve camshaft;

e) a second control valve sub-assembly disposed on an outer surface of said housing and having oil inlet and outlet ports in communication with said commutator in said second cam phaser sub-assembly for passing oil into and out of said chambers to vary the phase relationship between said crankshaft and said exhaust valve camshaft.

2. A cam phaser module in accordance with claim 1, further comprising means for sensing the rotational performance of said intake valve camshaft with respect to the crankshaft, and means for sensing the rotational performance of said exhaust valve camshaft with respect to the crankshaft.

3. A cam phaser module in accordance with claim 2, wherein each of said means for sensing includes a respective ferromagnetic target wheel on each of said first cam phaser sub-assembly and said second cam phaser sub-assembly, and an inductive sensor corresponding to each of said ferromagnetic target wheels on said housing.

4. A cam phaser module in accordance with claim 1, wherein said housing is so formed and connectable to said engine as to form a closed shroud around said first and second cam phaser sub-assembly.

5. A cam phaser module in accordance with claim 1, wherein said housing is further provided with passages for receiving oil from said engine and conveying oil to each said control valve sub-assembly.

6. A cam phaser module in accordance with claim 5 wherein said passages further comprise oil filtering means.

7. A cam phaser module in accordance with claim 1, wherein each said stator and each said cover plate are secured to and fixedly rotatable with a corresponding said timing sprocket, and each said rotor is secured to and fixedly rotatable with a corresponding one of said intake valve camshaft and said exhaust valve camshaft.

8. A cam phaser module in accordance with claim 1, wherein each said rotor is further provided with a plurality of vanes equal in number to the corresponding said plurality of chambers, each of said vanes being disposed in a corresponding one of said chambers for subdividing said chambers into first and second subchambers, all of said first subchambers being in communication with one of said oil inlet and outlet ports on a corresponding one of said first and second valve, and all of said second subchambers being in communication with the other of said oil inlet and outlet ports on said corresponding one of said first and second valve.

9. A cam phaser module in accordance with claim 1, wherein each said control valve sub-assembly includes a respective spool valve and a respective solenoid actuator.

10. A cam phaser module in accordance with claim 1, further comprising means for locking each said rotor into fixed phase relationship with a corresponding said stator.

11. A cam phaser module in accordance with claim 10, wherein said locking means includes a spring-biased pin axially-slidable in a bore and restrained in said bore in said rotor by pressurized oil, and a socket in said stator for receiving an end of said pin when the pressure of said oil is insufficient to overcome the biasing force of a spring biasing the pin.

* * * * *